US009427951B2

(12) United States Patent
Kamoda et al.

(10) Patent No.: US 9,427,951 B2
(45) Date of Patent: Aug. 30, 2016

(54) PRINTING PRESS

(71) Applicant: KOMORI CORPORATION, Tokyo (JP)

(72) Inventors: Hiroyoshi Kamoda, Ibaraki (JP); Taichi Kawase, Ibaraki (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 14/838,277

(22) Filed: Aug. 27, 2015

(65) Prior Publication Data

US 2016/0059541 A1 Mar. 3, 2016

(30) Foreign Application Priority Data

Aug. 29, 2014 (JP) ..... 2014-174856

(51) Int. Cl.

| | |
|---|---|
| ***B41F 7/02*** | (2006.01) |
| ***B41F 7/04*** | (2006.01) |
| ***B41F 7/06*** | (2006.01) |
| ***B41F 5/02*** | (2006.01) |
| ***B41F 11/02*** | (2006.01) |
| ***B41F 7/24*** | (2006.01) |
| ***B41F 7/26*** | (2006.01) |
| ***B41F 7/40*** | (2006.01) |

(52) U.S. Cl.

CPC ..... *B41F 7/24* (2013.01); *B41F 7/025* (2013.01); *B41F 7/04* (2013.01); *B41F 7/26* (2013.01); *B41F 7/40* (2013.01); *B41F 11/02* (2013.01); *B41F 5/02* (2013.01); *B41F 7/02* (2013.01); *B41F 7/06* (2013.01)

(58) Field of Classification Search

CPC ..... B41F 11/02; B41F 7/02; B41F 7/06; B41F 5/02

See application file for complete search history.

(56) References Cited

U.S. PATENT DOCUMENTS 5,042,378 A * 8/1991 Germann ..... B41F 11/02 101/152
6,772,709 B2 * 8/2004 Shibata ..... B41F 23/08 101/229

FOREIGN PATENT DOCUMENTS

EP 2 583 828 A1 4/2013
JP 2003127321 A * 5/2003
JP 2013-086437 A 5/2013

OTHER PUBLICATIONS

Extended Search Report in European Application No. 15 00 2438 dated Mar. 10, 2016. 8 pages.

* cited by examiner

*Primary Examiner* — Robert Huber
*Assistant Examiner* — John M Royston
(74) *Attorney, Agent, or Firm* — Blakely Sokoloff Taylor & Zafman LLP

(57) ABSTRACT

A printing press includes an impression cylinder, a blanket cylinder, a collecting plate cylinder, a collecting blanket cylinder, a plurality of partial plate cylinders, a plurality of inking devices, and a dampening unit. The impression cylinder holds and transports a sheet. The blanket cylinder is in contact with the impression cylinder. The collecting plate cylinder is in contact with the blanket cylinder, and a lithographic printing plate is mounted on the collecting plate cylinder. The collecting blanket cylinder is in contact with the collecting plate cylinder. The plurality of partial plate cylinders are in contact with the collecting blanket cylinder. The plurality of inking devices supply ink to the plurality of partial plate cylinders, respectively. The dampening unit supplies dampening water to the collecting plate cylinder.

5 Claims, 4 Drawing Sheets

RELATED ART

PRINTING PRESS

BACKGROUND OF THE INVENTION

The present invention relates to a printing press.

The Sammeldruck printing method is known as a special printing method capable of performing multicolor printing at once by applying inks of a plurality of colors to separate portions of one plate surface. A related Sammeldruck printing press that executes the Sammeldruck printing method is, e.g., one having an arrangement as shown in FIG. 5.

A Sammeldruck printing press 21 shown in FIG. 5 is an apparatus that performs Sammeldruck printing on a sheet 22, and includes a printing unit 23. The sheet 22 is transported on a transport path 26 constituted by an impression cylinder 24 of the printing unit 23 and a transport cylinder 25 in contact with the impression cylinder 24.

The printing unit 23 includes the impression cylinder 24, a blanket cylinder 28 in contact with the impression cylinder 24, a collecting plate cylinder 29 in contact with the blanket cylinder 28, a collecting blanket cylinder 30 in contact with the collecting plate cylinder 29, two partial plate cylinders 31 in contact with the collecting blanket cylinder 30, and two inking devices 32 that supply ink to the partial plate cylinders 31. A printing configuration having the cylinder array of the impression cylinder 24, the blanket cylinder 28, the collecting plate cylinder 29, the collecting blanket cylinder 30, and the plurality of partial plate cylinders 31 is called a Sammeldruck configuration. In the Sammeldruck printing press 21, a dry offset plate 33 and dry offset plates 34 are mounted on the collecting plate cylinder 29 and the two partial plate cylinders 31 in the Sammeldruck configuration, respectively.

In Sammeldruck printing by the Sammeldruck printing press 21, a plurality of colors are printed on the same drawing line without misregistration, and a drawing line whose color changes midway can be printed. Sammeldruck printing has a feature in which no misregistration occurs, and is often employed to prevent forgery of printing products. A printing press employing Sammeldruck printing is disclosed in, e.g., Japanese Patent Laid-Open No. 2013-86437.

Printing presses as described above are strongly requested to perform more advanced forgery prevention printing.

SUMMARY OF THE INVENTION

The present invention has been made to meet this demand, and has as its object to provide a printing press capable of performing more advanced forgery prevention printing.

To achieve the above object, according to the present invention, there is provided a printing press comprising an impression cylinder which holds and transports a sheet, a blanket cylinder which is in contact with the impression cylinder and on which a first blanket is mounted, a collecting plate cylinder which is in contact with the blanket cylinder and on which a first plate including a lithographic printing plate is mounted, a collecting blanket cylinder which is in contact with the collecting plate cylinder and on which a second blanket is mounted, a plurality of partial plate cylinders which are in contact with the collecting blanket cylinder and on which a plurality of second plates are mounted, respectively, a plurality of inking devices which correspond to the plurality of partial plate cylinders and supply ink to the plurality of partial plate cylinders, respectively, and a dampening unit which supplies dampening water to the collecting plate cylinder.

DESCRIPTION OF THE PREFERRED EMBODIMENTS

Figure 1:
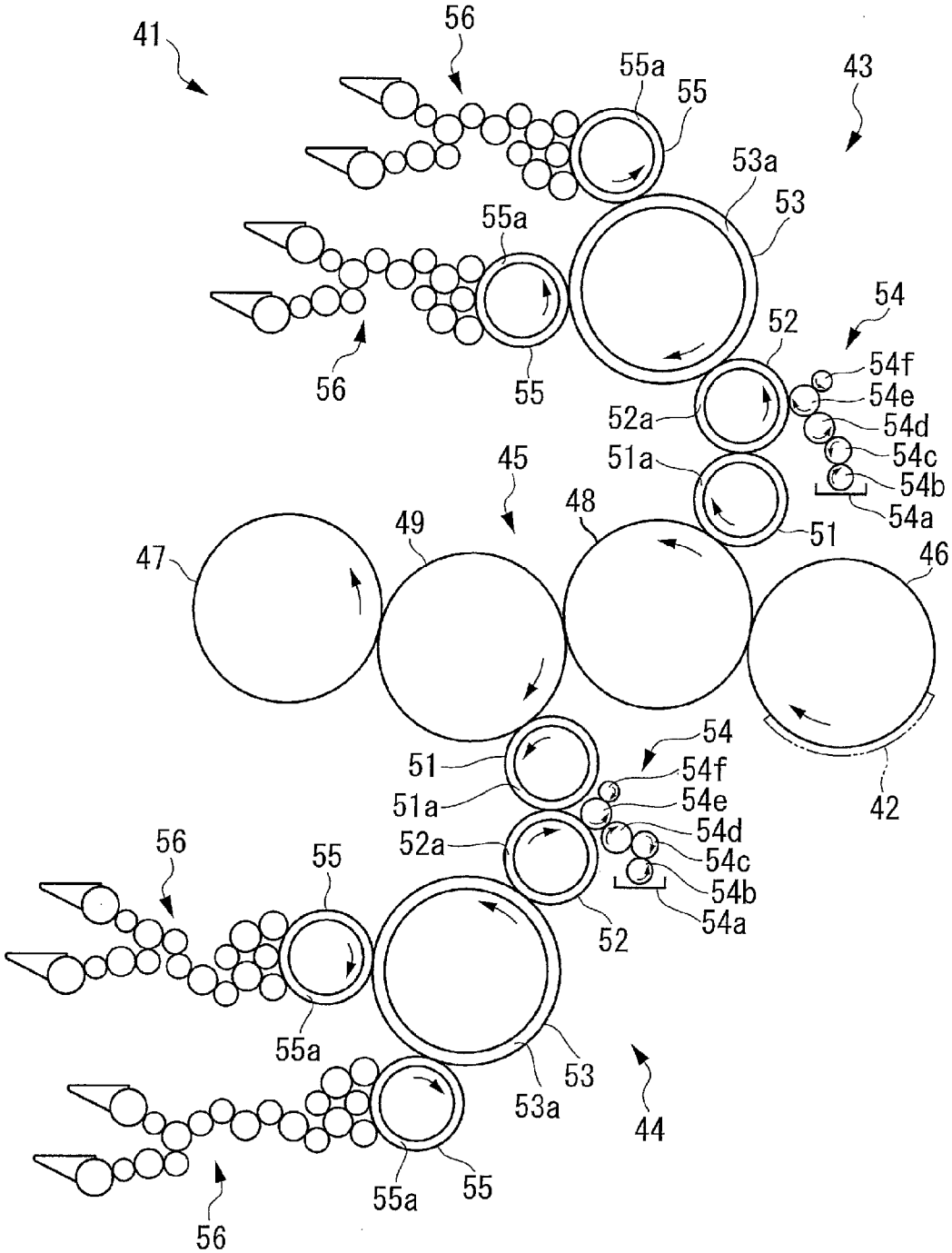
FIG. 1 is a side view showing a printing press according to an embodiment of the present invention.

A printing press according to an embodiment of the present invention will now be described in detail with reference to FIG. 1. A printing press 41 shown in FIG. 1 is an apparatus that performs printing on the two surfaces of a sheet 42, and includes a first printing unit 43 shown on the upper part of FIG. 1, and a second printing unit 44 shown on the lower part of FIG. 1. The first printing unit 43 and the second printing unit 44 are printing units each having a Sammeldruck configuration, and take the same configuration. Thus, in the following explanation of the first printing unit 43 and second printing unit 44, the same reference numerals denote parts having the same functions, and a repetitive description for each printing unit will be omitted. The "Sammeldruck configuration" is a printing configuration having a cylinder array constituted by first and second impression cylinders 48 and 49, a blanket cylinder 51 serving as the first blanket cylinder, a collecting plate cylinder 52, a collecting blanket cylinder 53, and a plurality of partial plate cylinders 55, which will be described later.

The sheet 42 is transported on a transport path 45 provided between the first printing unit 43 and the second printing unit 44. The transport path 45 is constituted by the first impression cylinder 48 and second impression cylinder 49 that are positioned between a first transport cylinders 46 positioned upstream in the transport direction and a second transport cylinders 47 positioned downstream in the transport direction. The first transport cylinder 46 is in contact with the first impression cylinder 48, the first impression cylinder 48 is in contact with the second impression cylinder 49, and the second impression cylinder 49 is in contact with the second transport cylinder 47. The sheet 42 is sequentially held by the first transport cylinder 46, the first impression cylinder 48, the second impression cylinder 49, and the second transport cylinder 47, and transported from right to left in FIG. 1. Although not shown, the first and second transport cylinders 46 and 47 and the first and second impression cylinders 48 and 49 that constitute the transport path 45 include gripper devices for transferring the sheet 42.

The blanket cylinder 51 constituting part of the first printing unit 43 is in contact with the upper portion of the first impression cylinder 48 positioned upstream in the transport direction, out of the first impression cylinder 48 and the second impression cylinder 49. The blanket cylinder 51 constituting part of the second printing unit 44 is in contact with the lower portion of the second impression cylinder 49. A blanket 51*a* serving as the first blanket is mounted on the outer surface portion of the blanket cylinder 51. Ink is transferred from the collecting plate cylinder 52 (to be described later) to the blanket 51*a*.

The collecting plate cylinder 52 is in contact with the blanket cylinder 51. A printing plate 52*a* serving as the first plate including a lithographic printing plate is mounted on the outer surface portion of the collecting plate cylinder 52. As the printing plate 52*a*, a so-called PS plate is used. The collecting plate cylinder 52 in the embodiment allows mounting a resin relief printing plate or a waterless lithographic printing plate instead of a lithographic printing plate.

A dampening unit 54 is connected to the collecting plate cylinder 52. The dampening unit 54 supplies dampening water to the collecting plate cylinder 52 on which the lithographic printing plate is mounted. The dampening unit 54 in this embodiment has a structure in which dampening water is supplied to the collecting plate cylinder 52 via a plurality of rollers from a water pan 54*a* in which dampening water is stored. A water fountain roller 54*b* positioned in the water pan 54*a*, a metering roller 54*c*, an oscillating roller 54*d*, and a form roller 54*e* are arranged and provided in the order named between the water pan 54*a* and the collecting plate cylinder 52. A rider roller 54*f* is in contact with the form roller 54*e*. The form roller 54*e* supplies dampening water to the collecting plate cylinder 52 by contact with the collecting plate cylinder 52. When a resin relief printing plate or a waterless lithographic printing plate is mounted on the collecting plate cylinder 52, the dampening unit 54 can be configured to separate the form roller 54*e* from the collecting plate cylinder 52 so as not to supply dampening water to the collecting plate cylinder 52.

The collecting blanket cylinder 53 is in contact with the collecting plate cylinder 52. A blanket 53*a* serving as the second blanket is mounted on the outer surface portion of the collecting blanket cylinder 53. Ink is transferred from the two partial plate cylinders 55 (to be described later) to the blanket 53*a*.

The two partial plate cylinders 55 are in contact with the collecting blanket cylinder 53. Printing plates 55*a* each serving as the second plate including a resin relief printing plate or a waterless lithographic printing plate are mounted on the two partial plate cylinders 55, respectively.

Inking devices 56 are connected to the partial plate cylinders 55, respectively. That is, the inking device 56 is provided for each partial plate cylinder 55. The two inking devices 56 supply inks of different colors to the two partial plate cylinders 55.

A case in which the printing press 41 performs Sammeldruck printing will be explained. Inks of different colors are supplied from the two inking devices 56 to the two partial plate cylinders 55, and the inks are transferred from the partial plate cylinders 55 to the collecting blanket cylinders 53. At this time, no dampening water is supplied to the partial plate cylinders 55, and only the inks from the inking devices 56 are supplied. When the inks are transferred from the collecting blanket cylinders 53 to the PS plates of the collecting plate cylinders 52, and dampening water is supplied from the dampening units 54 to the PS plates, drawing lines whose color changes midway are formed on the PS plates. The drawing lines formed on the collecting plate cylinders 52 are transferred to the blanket cylinders 51. The PS plate used for the collecting plate cylinder 52 can decrease the width of a drawing line, in comparison with a relief printing plate used in a related Sammeldruck printing press. According to this embodiment, ink can be transferred from the collecting plate cylinder 52 to the blanket cylinder 51 so as to print a thinner drawing line than that by the related Sammeldruck printing press.

When the sheet 42 passes between the blanket cylinder 51 of the first printing unit 43 and the first impression cylinder 48 in a state in which the ink has been transferred to the blanket cylinder 51, Sammeldruck printing is performed on one surface of the sheet 42. After printing on one surface, the sheet 42 is transferred from the first impression cylinder 48 to the second impression cylinder 49, and passes between the second impression cylinder 49 and the blanket cylinder 51 of the second printing unit 44. When the sheet 42 passes between the second impression cylinder 49 and the blanket cylinder 51 of the second printing unit 44, Sammeldruck printing is performed on the other surface of the sheet 42.

The printing press 41 can perform even conventional Sammeldruck printing by mounting a dry offset plate such as a resin relief printing plate or a waterless lithographic printing plate on the collecting plate cylinder 52, and separating the form roller 54*e* from the collecting plate cylinder 52 so as not to supply dampening water from the dampening unit 54 to the collecting plate cylinder 52. In addition, the printing press 41 can print a plurality of drawing lines at separate positions different from those in Sammeldruck printing by mounting a lithographic printing plate or a dry offset plate on the collecting plate cylinder 52.

Figure 2:
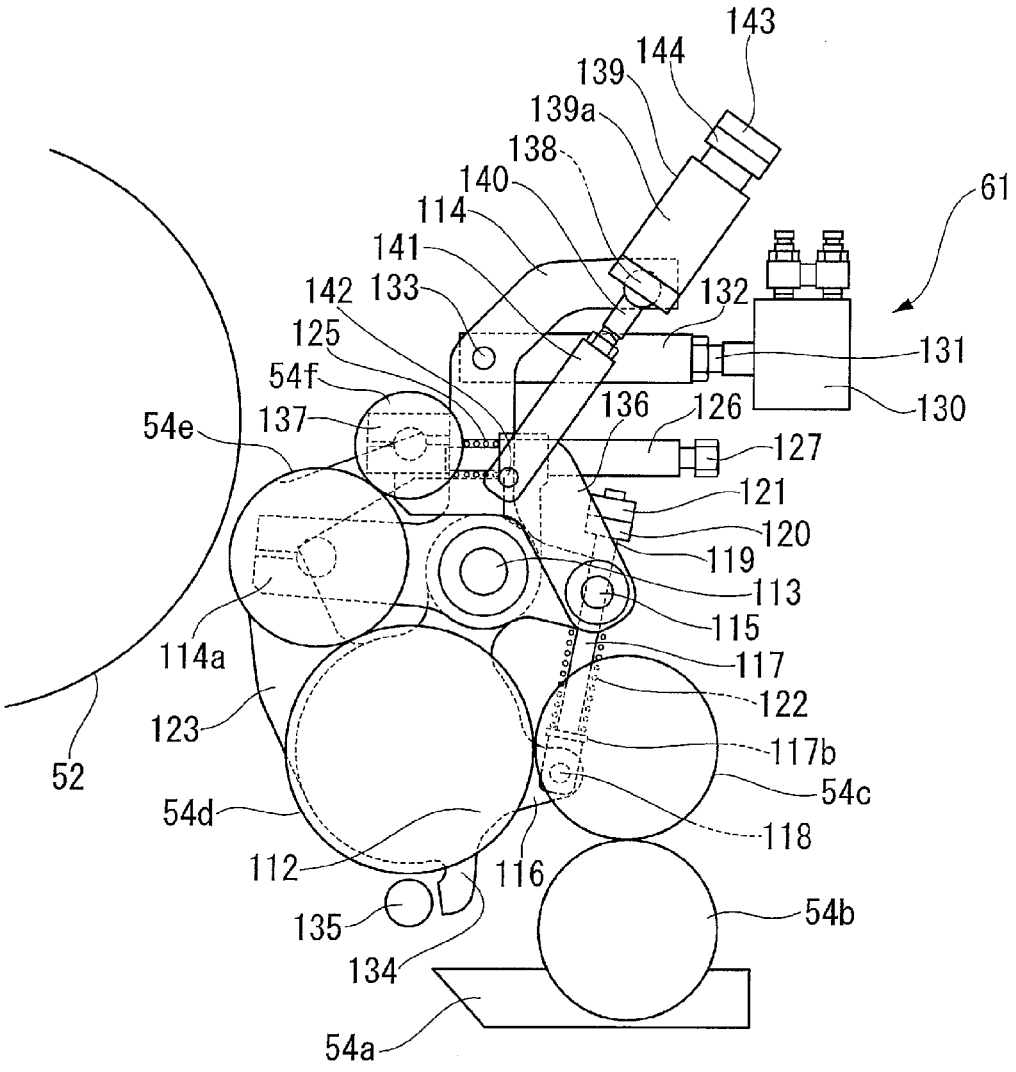
FIG. 2 is a side view showing a dampening unit.
Figure 3:
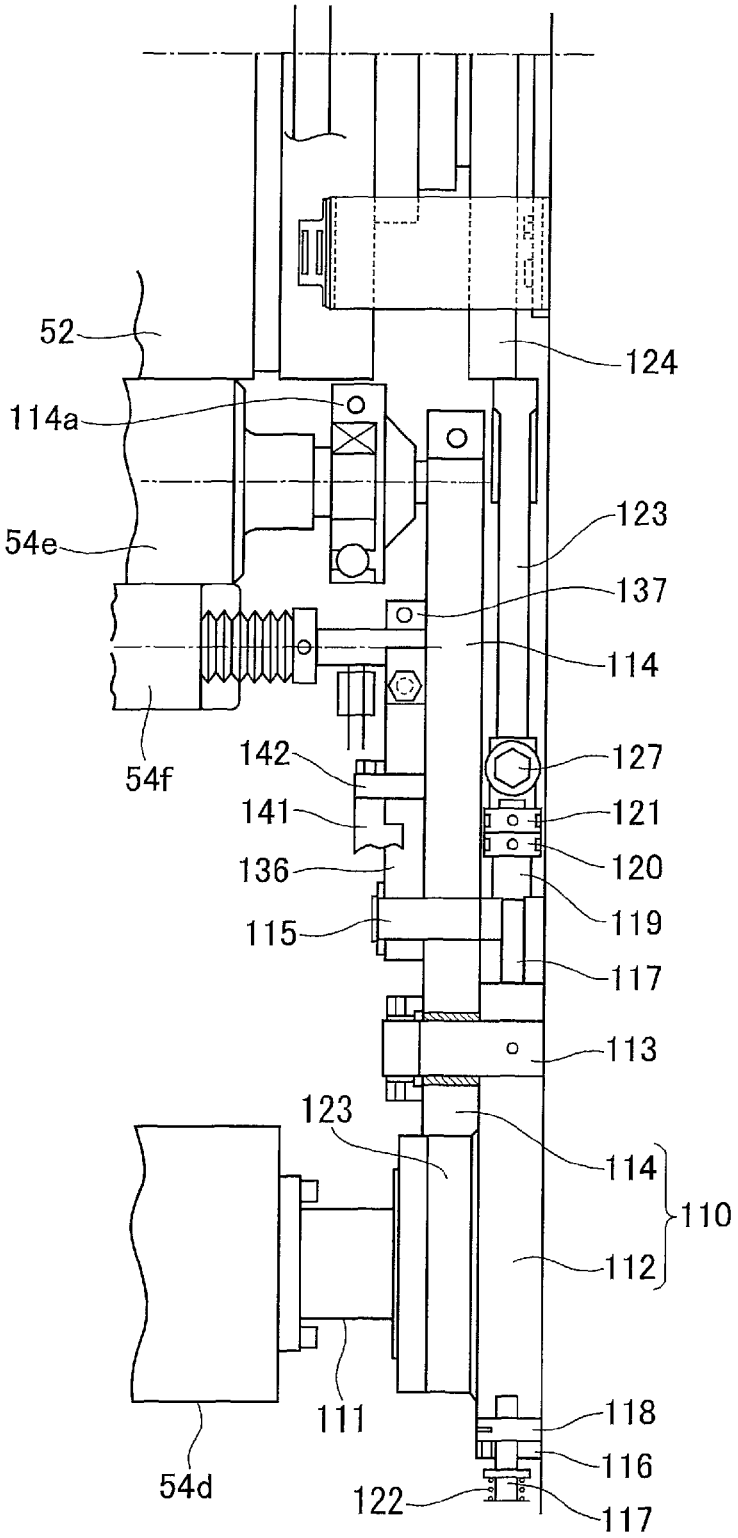
FIG. 3 is a partial sectional view showing a state in which the dampening unit is exploded when viewed two-dimensionally.
Figure 4:
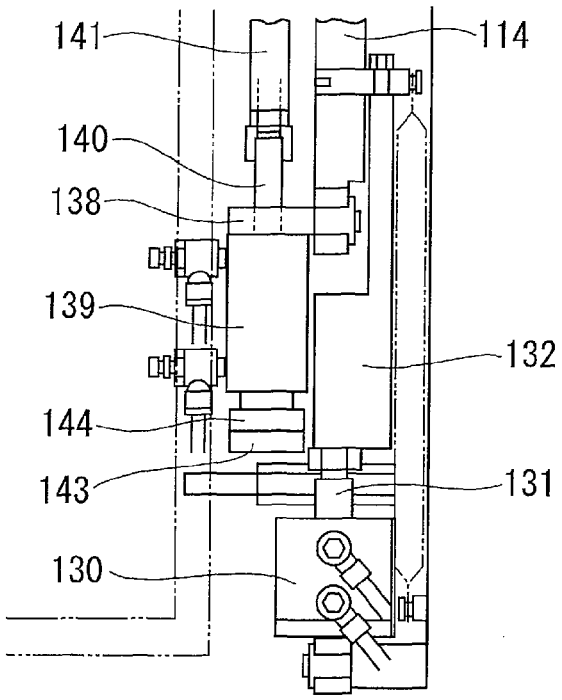
FIG. 4 is a partial sectional view showing a state in which the dampening unit is exploded when viewed two-dimensionally.
Figure 5:
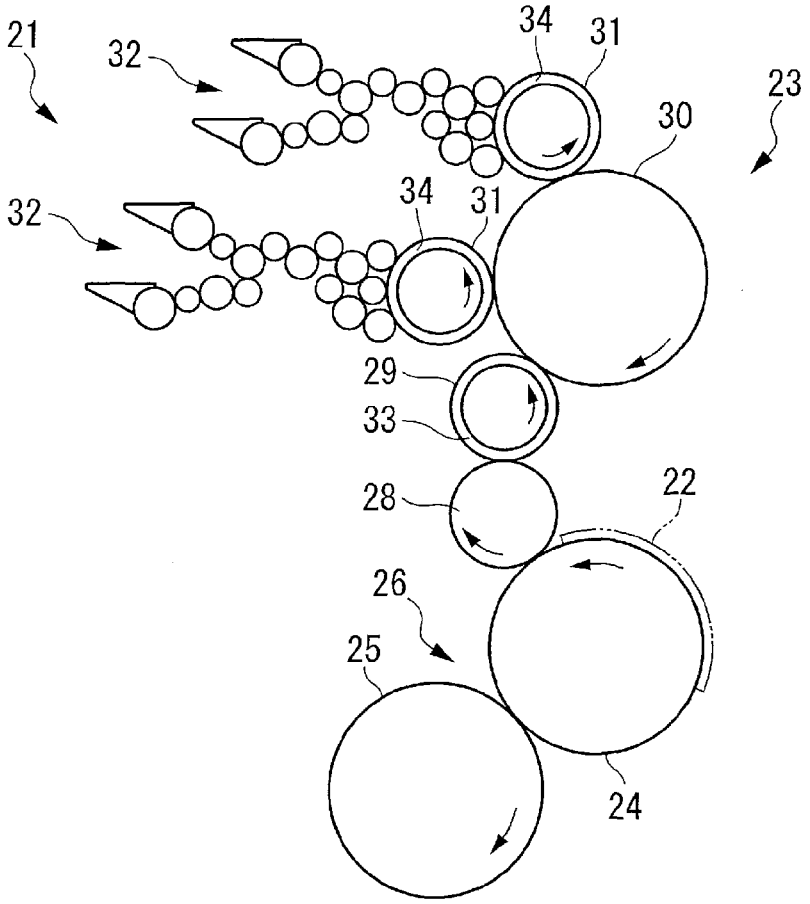
FIG. 5 is a side view showing a Sammeldruck printing press related to the present invention.

Next, the structure of the dampening unit 54 will be further explained with reference to FIGS. 2 to 4. The water fountain roller 54*b* is dipped in dampening water stored in the water pan 54*a*. The metering roller 54*c* contacts the water fountain roller 54*b*. The metering roller 54*c* can change the contact pressure with respect to the water fountain roller 54*b*.

The metering roller 54*c* contacts the oscillating roller 54*d*. The oscillating roller 54*d* is supported by a frame. A lever support lever 112 is rotatably provided at the end portion of a shaft 111 of the oscillating roller 54*d*. The lever support lever 112 extends to the upper side of the end portion of the shaft 111. A pin shaft 113 is fixed in the middle of the lever support lever 112. A form roller support lever 114 is pivotally attached to the pin shaft 113.

The form roller 54*e* held by a holder 114*a* is supported at one end of the form roller support lever 114. FIG. 2 shows a state in which the form roller 54*e* is separated from the collecting plate cylinder 52. A lever mechanism 100 is constituted by the form roller support lever 114 and the lever support lever 112. The lever mechanism 100 supports the form roller 54*e* so that the form roller 54*e* can come into contact with the collecting plate cylinder 52 and separate from the collecting plate cylinder 52. The lever mechanism 100 can be formed by one lever or more than two levers.

A pin shaft 115 is provided to extend through the other end portion of the form roller support lever 114. A bracket 116 is provided on the bottom side of the lever support lever 112. A rod 117 is interposed between an externally projecting portion of the pin shaft 115 and the bracket 116. An end portion of the rod 117 on the side of the bracket 116 is connected to the bracket 116 by a pin 118. The rod 117 extends upward through the pin shaft 115. A collar 119 is fitted on the rod 117 on the upper side of the pin shaft 115. Further, a fastening nut 120 and a locknut 121 are screwed at the screw portion of the upper end portion of the rod 117. A spring seat 117*b* is formed at a portion of the rod 117 on the side of the bracket 116. A spring 122 is provided between the spring seat 117*b* and the pin shaft 115. By the spring force of the spring 122, the form roller 54*e* is pressed against the oscillating roller 54*d* via the form roller support lever 114. The nip pressure between the form roller 54*e* and the oscillating roller 54*d* is adjusted by changing the fastening position of the fastening nut 120 and locknut 121 and changing the biasing force of the spring 122.

A twist follow-up lever 123 is coaxially supported by the shaft 111 of the oscillating roller 54*d*. The twist follow-up lever 123 is engaged with a twist follow-up cam 124 provided coaxially with the collecting plate cylinder 52. The lever support lever 112 and the form roller support lever 114 are operated from the twist follow-up cam 124 via the twist follow-up lever 123 with respect to a twist of the collecting plate cylinder 52, and the form roller 54*e* follows up the twist of the collecting plate cylinder 52.

A bolt shank 126 is interposed via a spring 125 between the end portion of the twist follow-up lever 123 and the upper end portion of the form roller support lever 114. A nut 127 is screwed in the screw portion of the bolt shank 126 extending through the upper end portion of the form roller support lever 114. The twist follow-up lever 123 is pressed against the twist follow-up cam 124 by the biasing force of the spring 125. The nip pressure of the form roller 54*e* with respect to the collecting plate cylinder 52 is adjusted by changing the projection amount of the bolt shank 126 from the lever support lever 112 by the nut 127.

A connecting rod 132 connected to a rod 131 of a throw-on and throw-off form roller cylinder (air cylinder) 130 fixed on the frame side is connected by a pin 133 to a portion of the form roller support lever 114 that extends upward. By the operation of the throw-on and throw-off form roller cylinder 130, the form roller support lever 114 and the lever support lever 112 pivot about the shaft center of the oscillating roller 54*d* to bring the form roller 54*e* into contact with the collecting plate cylinder 52 or separate the form roller 54*e* from the collecting plate cylinder 52. Note that a stopper bracket 134 is provided on the outer surface of the bottom portion of the lever support lever 112. The stopper bracket 134 hits against a stationary stopper 135 to limit the pivot amount of the lever support lever 112.

The rear end portion of a doglegged rider roller support lever 136 is pivotally attached to the inner portion of the pin shaft 115 at the rear end of the form roller support lever 114. The rider roller 54*f* is supported by a holder 137 at the distal end portion of the rider roller support lever 136. The rider roller 54*f* contacts the form roller 54*e* and reciprocates in the shaft direction. Since the rider roller 54*f* reciprocates, an ink accumulation film generated on the form roller 54*e* is spread to suppress emulsification accumulation and prevent contamination of printing products.

A throw-on and throw-off rider roller cylinder (air cylinder) 139 is pivotally supported by a pin shaft 138 at the upper end portion of the form roller support lever 114. A connecting rod 141 connected to a piston rod 140 of the throw-on and throw-off rider roller cylinder 139 is connected to the middle of the rider roller support lever 136 by a pin 142. When the throw-on and throw-off rider roller cylinder 139 extends, the rider roller support lever 136 pivots toward the form roller 54*e* and the rider roller 54*f* contacts the form roller 54*e*.

The throw-on and throw-off rider roller cylinder 139 is a double rod air cylinder. Nuts 143 and 144 are screwed in a portion of the piston rod 140 that projects from the rear portion of a cylinder main body 139*a*. By changing the positions of the nuts 143 and 144 to adjust the stroke of the piston rod 140, the nip pressure of the rider roller 54*f* with respect to the form roller 54*e* is adjusted.

Next, the operation of the dampening unit 54 will be explained. When performing printing in a state in which dampening water is supplied to the collecting plate cylinder 52, the throw-on and throw-off form roller cylinder 130 extends, i.e., operates to the pressing side to bring the collecting plate cylinder 52 and the form roller 54*e* into contact with each other, and the form roller 54*e* and the oscillating roller 54*d* into contact with each other. The throw-on and throw-off rider roller cylinder 139 also extends to bring the rider roller 54*f* into contact with the form roller 54*e*.

When performing printing in a state in which no dampening water is supplied to the collecting plate cylinder 52, the throw-on and throw-off form roller cylinder 130 contracts, i.e., operates to the pulling side. By the contacting operation of the throw-on and throw-off form roller cylinder 130, the form roller support lever 114 and the lever support lever 112 rotate about the shaft center of the oscillating roller 54*d*, and the form roller 54*e* is separated from the collecting plate cylinder 52. The stopper bracket 134 of the lever support lever 112 hits against the stopper 135, and the lever support lever 112 stops. However, the form roller support lever 114 further rotates about the pin shaft 113 on the lever support lever 112, and the form roller 54*e* is separated from the oscillating roller 54*d*.

When, for example, cleaning the form roller 54*e*, the throw-on and throw-off rider roller cylinder 139 further contracts, the rider roller support lever 136 pivots about the pin shaft 115 at the rear end portion of the form roller support lever 114, and the rider roller 54*f* is separated from the form roller 54*e*. As a result, a space for cleaning or the like is formed above the form roller 54*e*, facilitating cleaning of the form roller 54*e*, inspection, and the like.

In the dampening unit 54, the rider roller support lever 136 is pivotally supported on the form roller support lever 114. Thus, the form roller 54*e* follows up a twist of the collecting plate cylinder 52, as described above, and the rider roller 54*f* also follows up the form roller 54*e*. That is, the nip pressure between the form roller 54*e* and the rider roller 54*f* does not change in any state and the performance is not degraded.

With the dampening unit 54, printing in a state in which dampening water is supplied to the collecting plate cylinder 52, and printing in a state in which no dampening water is supplied to the collecting plate cylinder 52 can be switched by bringing the form roller 54*e* into contact with the collecting plate cylinder 52 and separating the form roller 54*e* from the collecting plate cylinder 52. A switching mechanism 61 that implements this function is mainly constituted by the lever mechanism 110 and the throw-on and throw-off form roller cylinder 130 serving as an actuator connected to the lever mechanism 110.

Next, the effects of this embodiment will be explained. The printing plate 52*a* of the collecting plate cylinder 52 is a lithographic printing plate, and the printing press 41 according to this embodiment includes the dampening unit 54 that supplies dampening water to the collecting plate cylinder 52. The printing press 41 can perform, on the sheet 42, printing of a very fine pattern or design exploiting the feature of lithographic printing using dampening water. For example, the printing press 41 can even print, on the sheet 42, an extra fine line whose color changes midway. This embodiment can therefore provide a printing press capable of performing more advanced forgery prevention printing on the sheet 42.

In this embodiment, a relief printing plate can be used as the printing plate 55*a* of the partial plate cylinder 55. Since ink can be transferred to the collecting blanket cylinder 53 with high accuracy, a finer drawing line can be printed on the sheet 42. Although this embodiment has explained an example in which the two partial plate cylinders 55 are provided, three or more partial plate cylinders 55 may also be provided. In this case, a plurality of printing plates 55*a* are mounted on the plurality of partial plate cylinders 55, respectively. Also, a plurality of inking devices 56 are provided in correspondence with the respective partial plate cylinders 55.

Although not shown, the printing press 41 according to this embodiment can be connected to another printing press and used. That is, the printing press 41 can be connected to the downstream end portion of another printing press or can be connected to the upstream end portion of another printing press. The printing press 41 can also be provided between a plurality of other printing presses. The other printing presses are, for example, an intaglio printing press and an alternate double-sided offset printing press.

Although this embodiment has described the printing press 41 that performs Sammeldruck printing on the two surfaces of the sheet 42, the present invention is not limited to this. That is, the present invention is applicable to even a printing press that performs Sammeldruck printing on only one surface of the sheet 42.

What is claimed is:

1. A printing press comprising:

an impression cylinder which holds and transports a sheet;

a blanket cylinder which is in contact with the impression cylinder and on which a first blanket is mounted;

a collecting plate cylinder which is in contact with the blanket cylinder and on which a first plate including a lithographic printing plate is mounted;

a collecting blanket cylinder which is in contact with the collecting plate cylinder and on which a second blanket is mounted;

a plurality of partial plate cylinders which are in contact with the collecting blanket cylinder and on which a plurality of second plates are mounted, respectively;

a plurality of inking devices which correspond to the plurality of partial plate cylinders and supply ink to the plurality of partial plate cylinders, respectively; and a dampening unit which supplies dampening water to the collecting plate cylinder, the dampening unit including a form roller which supplies the dampening water to the collecting plate cylinder by contact with the collecting plate cylinder.

2. The printing press according to claim 1, wherein each of the plurality of second plates includes one of a relief printing plate and a waterless lithographic printing plate.

3. The printing press according to claim 1, wherein only ink from the plurality of inking devices is supplied to the plurality of partial plate cylinders without supplying dampening water.

4. The printing press according to claim 1, wherein the dampening unit includes:

a switching mechanism which switches between printing in a state in which the dampening water is supplied to the collecting plate cylinder, and printing in a state in which the dampening water is not supplied to the collecting plate cylinder, by bringing the form roller into contact with the collecting plate cylinder and separating the form roller from the collecting plate cylinder.

5. The printing press according to claim 1, wherein the first plate is configured such that a drawing line whose color changes midway is formed on the first plate from first ink supplied from one of the plurality of inking devices and second ink supplied from another of the plurality of inking devices, the color of the first ink being different from that of the second ink.

* * * * *